US011373568B2

(12) United States Patent
Kong et al.

(10) Patent No.: US 11,373,568 B2
(45) Date of Patent: Jun. 28, 2022

(54) LED GHOST IMAGE REMOVAL

(71) Applicant: Dialog Semiconductor (UK) Limited, London (GB)

(72) Inventors: Lingxin Kong, Beijing (CN); Xiaogang Zhao, Beijing (CN); Ze Han, Beijing (CN); Nailong Wang, Beijing (CN); Zhenyu Song, Beijing (CN)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 16/245,563

(22) Filed: Jan. 11, 2019

(65) Prior Publication Data

US 2019/0223266 A1 Jul. 18, 2019

Related U.S. Application Data

(63) Continuation of application No. PCT/CN2018/072451, filed on Jan. 12, 2018.

(51) Int. Cl.
*H05B 45/32* (2020.01)
*G09G 3/14* (2006.01)
*H05B 45/46* (2020.01)

(52) U.S. Cl.
CPC ..... *G09G 3/14* (2013.01); *H05B 45/46* (2020.01)

(58) Field of Classification Search
CPC ..... H05B 33/0815; H05B 33/0827; H05B 33/0845; H05B 45/46; H05B 45/325
USPC ..... 315/186, 192, 193
See application file for complete search history.

(56) References Cited

U.S. PATENT DOCUMENTS 8,222,838 B2 * 7/2012 Takeuchi ..... H05B 45/46 315/362
8,334,662 B2 12/2012 Jin
8,659,514 B2 2/2014 Sato
8,686,651 B2 * 4/2014 Lynch ..... H05B 45/46 315/192
9,107,265 B2 * 8/2015 Lin ..... H05B 45/46
9,313,855 B1 * 4/2016 Sivertsen ..... H05B 47/11
(Continued)

FOREIGN PATENT DOCUMENTS

CN 103426396 A 12/2013
CN 104464639 3/2015
CN 105374317 3/2016

OTHER PUBLICATIONS

PCT International Search Report and Written Opinion, International Application No. PCT/CN2018/072451, dated Oct. 11, 2018, 10 pages.

(Continued)

*Primary Examiner* — Tung X Le
(74) *Attorney, Agent, or Firm* — Saile Ackerman LLC; Stephen B. Ackerman

(57) ABSTRACT

A light emitting diode (LED) circuit for preventing parasitic current flow through a first LED when the first LED is in an off state is described, where the parasitic current flow is a result of one or more parasitic capacitances, the LED circuit comprising the first LED, and a first current switch coupled to the first LED and arranged to enable a current flow through the first LED when the first current switch is in an on state, where the first current switch is arranged to discharge the one or more parasitic capacitances when the first current switch is in the on state.

14 Claims, 13 Drawing Sheets

(56) References Cited

U.S. PATENT DOCUMENTS

| | | | | |
|---|---|---|---|---|
| 9,451,664 | B2 | 9/2016 | Jin | |
| 2008/0266277 | A1* | 10/2008 | Ichikura | G09G 3/3216 345/205 |
| 2010/0295845 | A1 | 11/2010 | Somerville et al. | |
| 2013/0314307 | A1* | 11/2013 | Lin | G09G 3/32 345/82 |
| 2014/0347255 | A1* | 11/2014 | Chiu | G09G 3/32 345/82 |
| 2016/0360584 | A1* | 12/2016 | Xie | H05B 45/44 |
| 2017/0027032 | A1 | 1/2017 | Kong et al. | |
| 2019/0147795 | A1* | 5/2019 | Yao | G09G 3/32 |

OTHER PUBLICATIONS

"Eliminating Ghost-Image Currents in Color-LED Display Systems Using the MAX6972-MAX6975 LED Drivers," maxim integrated, Maxim > Design Support > Technical Documents > Application Notes > Miscellaneous Circuits > Application Note 4111, pp. 1-10.

Chinese Office Action, Application No.: 201880002893X, Applicant: Dialog Semiconductor (UK) Limited, dated Feb. 23, 2022, 12 pages.

* cited by examiner

LED GHOST IMAGE REMOVAL

This application is a Continuation application (DS17-085G) of application no. PCT/CN2018/072451, filed on Jan. 12, 2018, owned by a common assignee, and which is herein incorporated by reference in its entirety.

TECHNICAL FIELD

The present disclosure relates to light emitting diode (LED) apparatus and methods for operating LED apparatus. In particular, this disclosure relates to ghost image removal in multiplexed LED circuitry.

BACKGROUND

A multiplexed light emitting diode (LED) array is a type of LED circuit that may be used in applications involving LED matrix backlighting, where hundreds or thousands of LEDs are controlled independently to provide backlighting for a liquid crystal display (LCD). Alternatively, a multiplexed LED array may be used to provide an LED display. An LED is a diode that emits light. Types of LEDs include, but are not limited to, MiniLEDs and MicroLEDs. Types of LED displays include, but are not limited to, dot-matrix displays and multiple-segment displays such as: seven segment displays; nine segment displays; fourteen segment displays; and sixteen segment displays.

FIG. 1 is a schematic diagram of a multiplexed LED array 100 in accordance with the prior art. The multiplexed LED array comprises a plurality of LEDs and a plurality of switches. Operation of the switches controls the illumination of the LEDs. The switches are selectively operated so that the LEDs in the array 100 can be selectively switched on or off, so that desired illumination patterns can be created.

Parasitic capacitances are present in the multiplexed LED array 100 and may, for example, be a result of package pin capacitance, printed circuit board (PCB) tracking capacitance or LED capacitance.

FIG. 2 is an alternative schematic diagram of the multiplexed LED array 100 of FIG. 1 with parasitic capacitances shown. The parasitic capacitances are represented in the schematic diagram of the multiplexed LED array 100 in FIG. 2 by a plurality of parasitic capacitor symbols, and may be referred to herein generally as "parasitic capacitors" for convenience.

During operation of the multiplexed LED array 100, charge may be stored due to the parasitic capacitances, which can result in a ghost image. FIG. 3 is a schematic of a seven segment LED display counting sequentially from 1 to 3 to demonstrate ghost images.

At a first display step 300, the seven segment LED display illuminates a first segment 302 and a second segment 304, with the remaining segments switched off. At a second display step 306, the seven segment LED display illuminates the necessary segments to display the number "2", with the remaining segments switched off. However, the second segment 304, which should be switched off, appears dimly lit.

At a third display step 308, the seven segment LED display illuminates the necessary segments to display the number "3", with the remaining segments switched off. However, a third segment 310, which should be switched off, appears dimly lit.

The dimly lit segments are ghost images and result from the parasitic capacitances of the multiplexed LED array 100. It can be observed that the ghost images appear on segments which were illuminated on an immediately preceding display step and are switched off on the current display step.

Existing systems implement additional, dedicated circuitry to provide a resistive discharge path to discharge the parasitic capacitances to prevent the occurrence of ghost images.

SUMMARY

It is desirable to provide a multiplexed LED array that does not require additional, dedicated circuitry to prevent the occurrence of ghost images that arise due to parasitic capacitances.

According to a first aspect of the disclosure there is provided a light emitting diode (LED) circuit for preventing parasitic current flow through a first LED when the first LED is in an off state, wherein the parasitic current flow is a result of one or more parasitic capacitances, the LED circuit comprising the first LED and a first current switch coupled to the first LED and arranged to enable a current flow through the first LED when the first current switch is in an on state, wherein the first current switch is arranged to discharge the one or more parasitic capacitances when the first current switch is in the on state.

Optionally, the first current switch provides a current regulation function to provide the current flow through the first LED when the first current switch is in an on state.

Optionally, the first LED is in an on state when the first LED is coupled to a supply voltage and the first current switch is in the on state, otherwise the first LED is in the off state.

Optionally, the LED circuit comprises a first power switch, wherein the first LED is coupled to the supply voltage when the first power switch is in an on state, and the first LED is decoupled from the supply voltage when the first power switch is in an off state.

Optionally, the first current switch is in the on state prior to the first power switch changing to the on state.

Optionally, the first current switch remains in the on state at least until the first power switch changes to the on state.

Optionally, the first current switch and the first power switch both change to the on state at approximately the same time.

Optionally, the one or more parasitic capacitances are discharged when the first current switch and the first power switch are both in the on state.

Optionally, the one or more parasitic capacitances are discharged when the first current switch is in the on state and the first power switch is in the off state.

Optionally, the first current switch is in the on state after the first power switch has changed to the off state.

Optionally, the first current switch remains in the on state whilst the first power switch changes from the on state to the off state.

Optionally, the parasitic capacitances comprise a first parasitic capacitance and a second parasitic capacitance.

Optionally, the LED circuit comprises a second LED and a second current switch coupled to the second LED and arranged to enable a current flow through the second LED when the second current switch is in an on state, wherein the second current switch is arranged to discharge the one or more of the first parasitic capacitance and other parasitic capacitances when the second current switch is in the on state.

Optionally, the other parasitic capacitances comprise a third parasitic capacitance.

Optionally, the first current switch provides a first current regulation function to provide the current flow through the first LED when the first current switch is in an on state and the first current switch is arranged to discharge one or more of the first and second parasitic capacitances and the second current switch provides a second current regulation function to provide the current flow through the second LED when the second current switch is in an on state and the second current switch is arranged to discharge one or more of the first and third parasitic capacitances.

Optionally, the first LED is in an on state when the first LED is coupled to a supply voltage and the first current switch is in the on state, otherwise the first LED is in the off state and the second LED is in an on state when the second LED is coupled to the supply voltage and the first current switch is in the on state, otherwise the second LED is in the off state.

Optionally, the LED circuit comprises a first power switch, wherein the first LED is coupled to the supply voltage when the first power switch is in an on state, and the first LED is decoupled from the supply voltage when the first power switch is in an off state and the second LED is coupled to the supply voltage when the first power switch is in an on state, and the second LED is decoupled from the supply voltage when the first power switch is in an off state.

Optionally, one or both of the first current switch and the second current switch are in the on state prior to the first power switch changing to the on state.

Optionally, one or both of the first current switch and the second current switch remain in the on state at least until the power switch changes to the on state.

Optionally, one or both of the first current switch and the second current switch to the on state at approximately the same time as the first power switch changes to the on state.

Optionally, the second parasitic capacitance is discharged when the first current switch and the first power switch are both in the on state, and the third parasitic capacitance is discharged when the second current switch and the first power switch are both in the on state.

Optionally, the first parasitic capacitance is discharged when at least one of the first current switch and the second current switch are in the on state and the first power switch is in the off state.

Optionally, at least one of the first current switch and the second current switch are in the on state after the first power switch has changed to the off state.

Optionally, the at least one of the first current switch and the second current switch remain in the on state whilst the first power switch is changed from the on state to the off state.

Optionally, the LED circuit comprises one or more LED strings, wherein each LED string comprises one or more LEDs.

According to a second aspect of the disclosure there is provided a method of operating a light emitting diode (LED) circuit of the type comprising a first LED, a first current switch and one or more parasitic capacitances, the method comprising enabling, via the first current switch, a current to flow through the first LED when the first current switch is in an on state and discharging, via the first current switch, the one or more parasitic capacitances when the first current switch is in the on state thus preventing parasitic current flow through the first LED when the first LED is in an off state, wherein the parasitic current flow is a result of the one or more parasitic capacitances.

According to a third aspect of the disclosure there is provided a controller for preventing parasitic current flow through a first LED when the first LED is in an off state, wherein the parasitic current flow is a result of one or more parasitic capacitances, wherein the controller is arranged to control the switching of a first current switch; wherein the first current switch is coupled to the first LED and arranged to enable a current flow through the first LED when the first current switch is in an on state and the first current switch is arranged to discharge the one or more parasitic capacitances when the first current switch is in the on state.

BRIEF DESCRIPTION OF THE DRAWINGS

The disclosure is described in further detail below by way of example and with reference to the accompanying drawings, in which.

DETAILED DESCRIPTION

Figure 1:
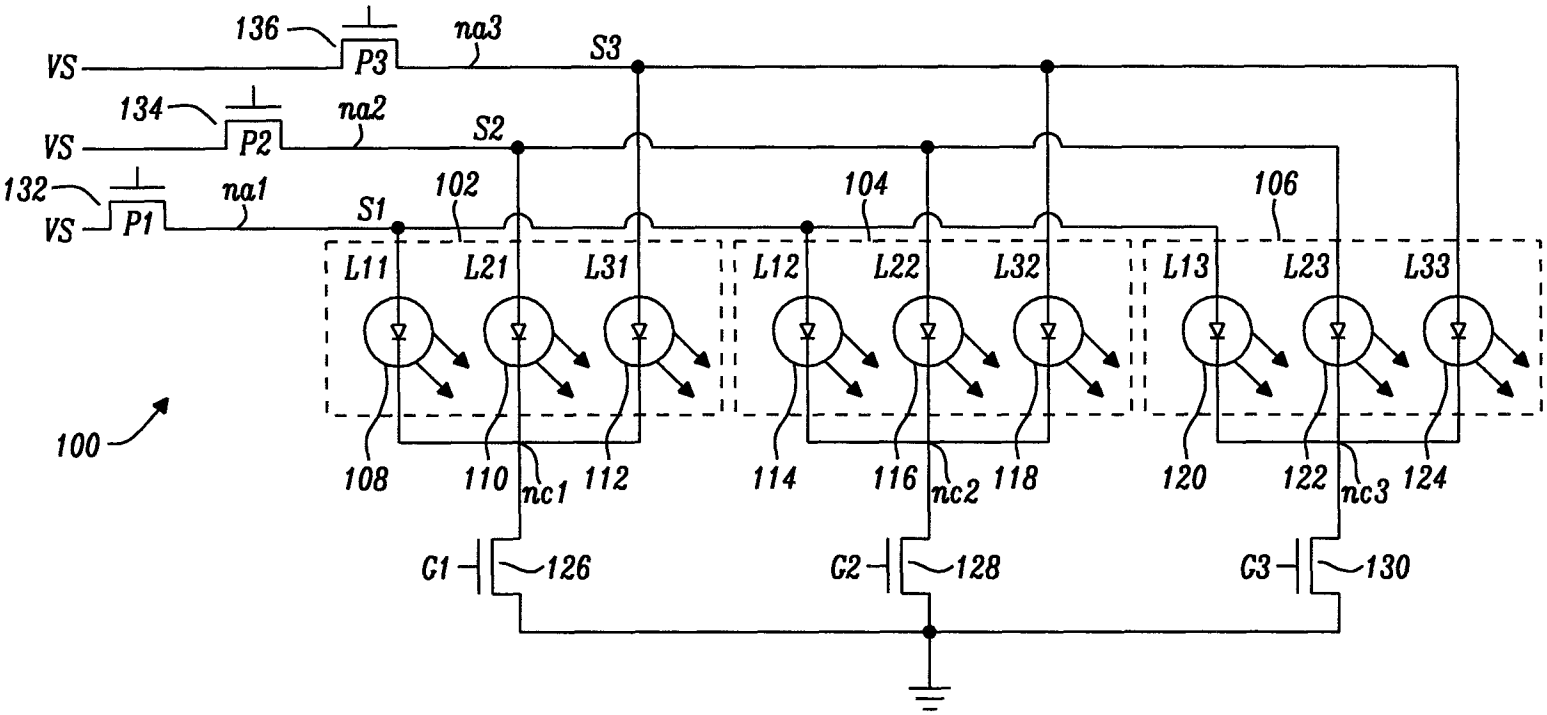
FIG. 1 Prior Art
FIG. 1 is a schematic diagram of a multiplexed LED array in accordance with the prior art.

The multiplexed LED array 100 comprises a plurality of LED strings, as shown in FIG. 1. The plurality of LED strings comprises a first LED string 102, a second LED string 104, and a third LED string 106. Each of the plurality of LED strings 102, 104, 106 comprises a plurality of LEDs. The first LED string 102 comprises a first LED 108, a second LED 110 and a third LED 112, which are also labelled L11, L21 and L31, respectively. The second LED string 104 comprises a fourth LED 114, a fifth LED 116 and a sixth LED 118, which are also labelled L12, L22 and L32, respectively. The third LED string 106 comprises a seventh LED 120, an eight LED 122 and a ninth LED 124, which are also labelled as L13, L23 and L33, respectively.

The LEDs in the array 100 are selectively operated under control of a set of switch elements. These switch elements preferably comprise a first set of power switches (P1, P2, P3 in this example), which are coupled with the anodes of the LEDs and a second set of current switches (G1, G2, G3 in this example), which are coupled with the cathodes of the LEDs.

In the example shown in FIG. 1, the first, second and third LEDs 108, 110, 112 each have a cathode terminal coupled to a first current switch 126 at a first common cathode node nc1. The fourth, fifth and sixth LEDs 114, 116, 118 each have a cathode terminal coupled to a second current switch 128 at a second common cathode node nc2. The seventh, eighth and ninth LEDs 120, 122, 124 each have a cathode terminal coupled to a third current switch 130 at a third common cathode node nc3. The first, second and third current switches 126, 128, 130 are also labelled G1, G2 and G3, respectively.

The first, fourth and seventh LEDs 108, 114, 120 each have an anode terminal coupled to a first power switch 132 at a first common anode node na1. The second, fifth and eighth LEDs 110, 116, 122 each have an anode terminal coupled to a second power switch 134 at a second common anode node na2. The third, sixth and ninth LEDs 112, 118, 124 each have an anode terminal coupled to a third power switch 136 at a third common anode node na3. The first, second and third power switches 132, 134, 136 are also labelled P1, P2 and P3, respectively.

The first, second, and third power switches 132, 134, 136 are arranged to couple the plurality of LEDs to a supply voltage VS (either directly or indirectly), when the power switches 132, 134, 136 are closed. The supply voltage VS is capable of supporting a current required for operation of the LEDs.

Figure 2:
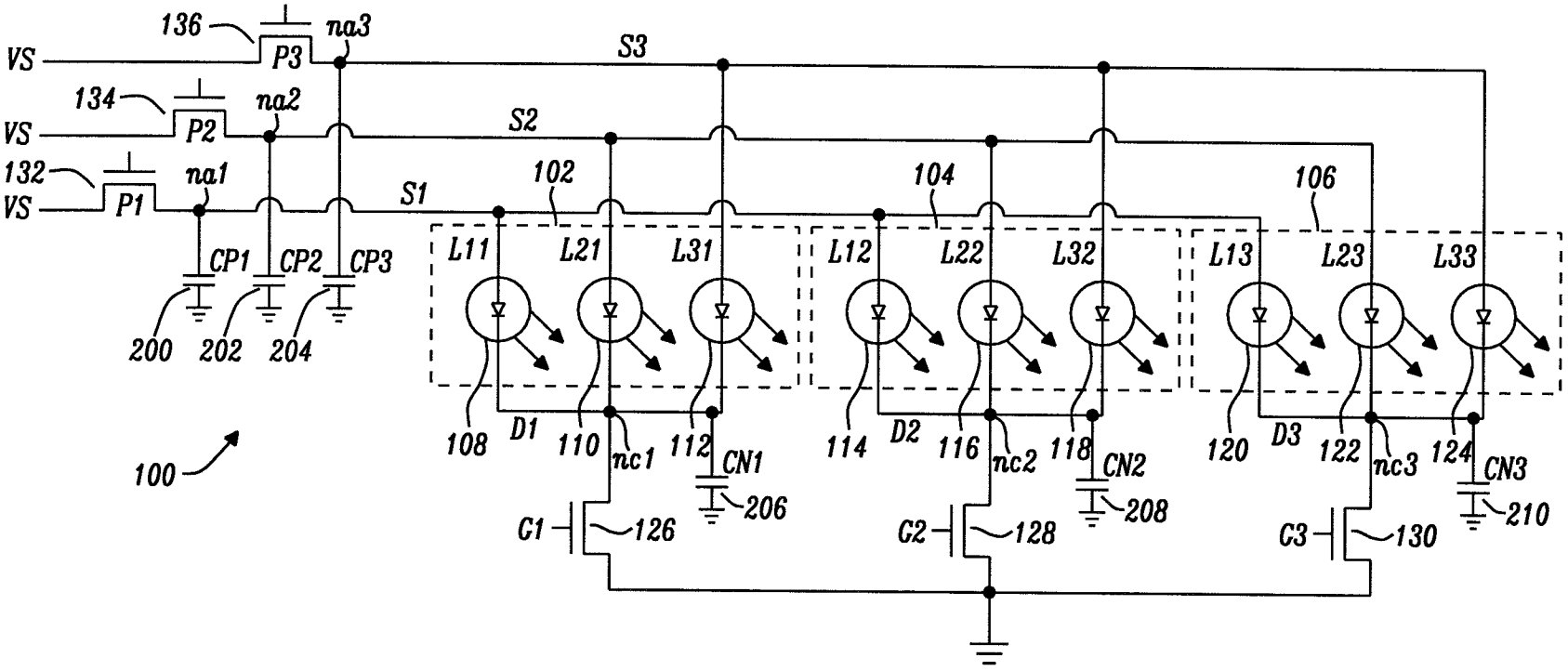
FIG. 2 Prior Art
FIG. 2 is a schematic diagram of a multiplexed LED array with parasitic capacitances shown, in accordance with the prior art.
Figure 3:
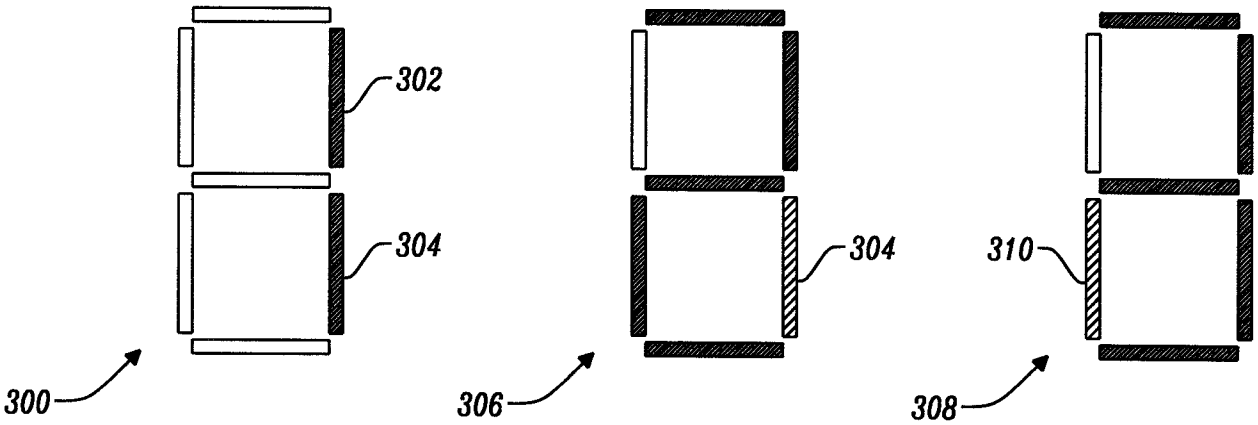
FIG. 3 Prior Art
FIG. 3 is an illustration of a 7 segment LED display, showing an illumination sequence to demonstrate ghost images.

As shown in FIG. 2, a first parasitic capacitor 200 has a first terminal coupled to the first common anode node na1 and a second terminal coupled to ground. A second parasitic capacitor 202 has a first terminal coupled to the second common anode node na2 and a second terminal coupled to ground. A third parasitic capacitor 204 has a first terminal coupled to the third common anode node na3 and a second terminal coupled to ground.

The first terminal of the first parasitic capacitor 200 is at a first anode voltage S1; the first terminal of the second parasitic capacitor 202 is at a second anode voltage S2; and the first terminal of the third parasitic capacitor 204 is at a third anode voltage S3.

A fourth parasitic capacitor 206 has a first terminal coupled to the first common cathode node nc1 and a second terminal coupled to ground. A fifth parasitic capacitor 208 has a first terminal coupled to the second common cathode node nc2 and a second terminal coupled to ground. A sixth parasitic capacitor 210 has a first terminal coupled to the third common cathode node nc3 and a second terminal coupled to ground.

The first terminal of the fourth parasitic capacitor 206 is at a first cathode voltage D1; the first terminal of the fifth parasitic capacitor 208 is at a second cathode voltage D2; and the first terminal of the sixth parasitic capacitor 210 is at a third cathode voltage D3.

The first, second, third, fourth, fifth and sixth parasitic capacitors 200, 202, 204, 206, 208, 210 are also labelled CP1, CP2, CP3, CN1, CN2 and CN3, respectively.

Figure 4:
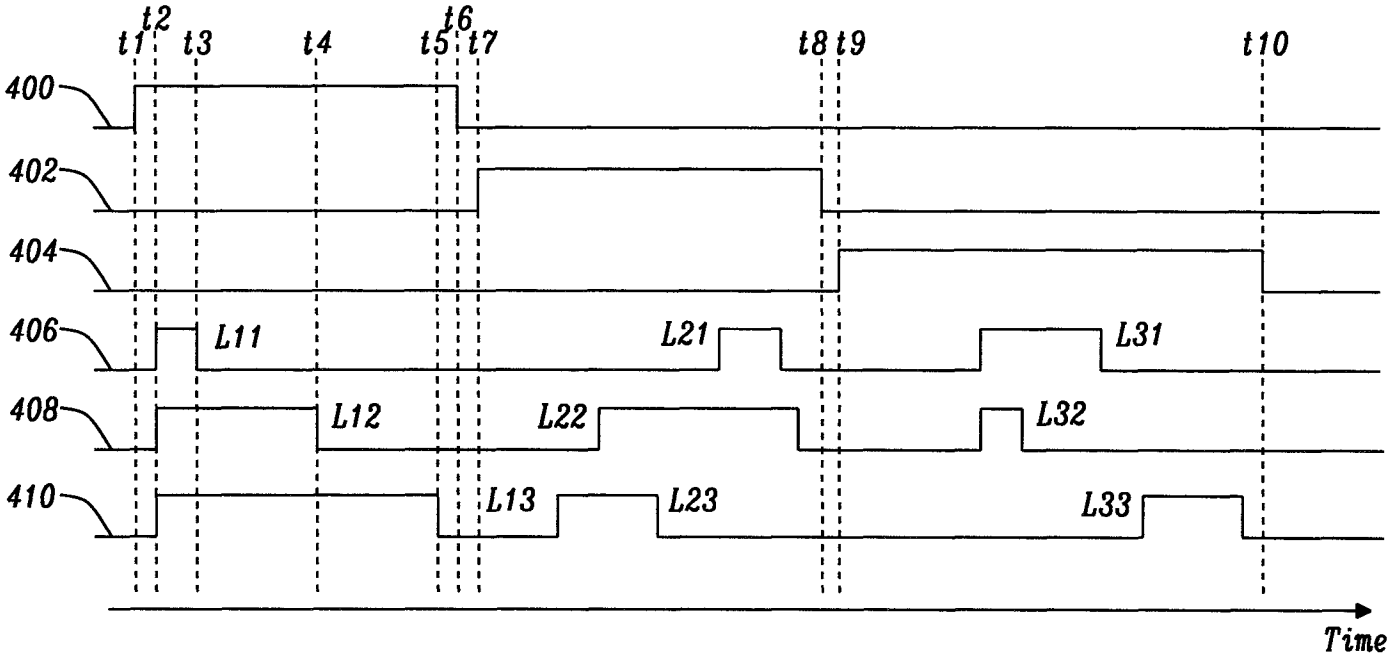
FIG. 4 Prior Art
FIG. 4 is a typical timing sequence of the switching operation of the multiplexed LED array of FIG. 1 and FIG. 2 in accordance with the prior art.

FIG. 4 shows a typical timing sequence of the switching operation of the power switches 132, 134, 136 and the current switches 126, 128, 130 of the multiplexed LED array 100 of FIG. 1 and FIG. 2. The timing sequence shows the following: a state 400 of the first power switch 132; a state 402 of the second power switch 134; a state 404 of the third power switch 136; a state 406 of the first current switch 126; a state 408 of the second current switch 128; and a state 410 of the third current switch 130. A high state denotes that the switch is closed and may alternatively be referred to as the switch being "on", meaning that a current may flow through the switch. A low state denotes that the switch is open and may alternatively be referred to as the switch being "off", meaning that a current does not flow through the switch.

The first current switch 126, when in an on state, may provide a current regulation function to provide a current flow through the first, second and third LEDs 108, 110, 112. The second current switch 128, when in an on state, may provide a current regulation function to provide a current flow through the fourth, fifth and sixth LEDs 114, 116, 118. The third current switch 130, when in an on state, may provide a current regulation function to provide a current flow through the seventh, eighth and ninth LEDs 120, 122, 124.

The current switches 126, 128, 130 may comprise transistors, for example MOSFETs. Pulse width modulation (PWM) may be used to control the switching of the current switches 126, 128, 130. The brightness of an LED can be adjusted by varying the PWM duty cycle whilst maintaining a constant current through the LED. Both the current flowing through the LED and the PWM duty cycle may be changed simultaneously.

The power switches 132, 134, 136 may comprise transistors, for example MOSFETs. Pulse width modulation (PWM) is used to control the switching of the power switches 132, 134, 136. In FIG. 4, prior to time t1 all switches 126, 128, 130, 132, 134, 136 are in a low state. At time t1, the state 400 of the first power switch 132 changes to a high state. At time t2, the states 406, 408, 410 of the current switches 126, 128, 130 changes to a high state. At time t3, the state 406 of the first current switch 126 then returns to a low state. At time t4, the state 408 of the second current switch 128 returns to a low state. At time t5 the state 410 of the third current switch 130 returns to a low state. At time t6 the state 400 of the first power switch 132 returns to a low state. Between time t6 and time t7, all switches 126, 128, 130, 132, 134, 136 are in a low state.

A pulse width of a power switch 132, 134, 136 is a duration of time over which its state 400, 402, 404 is high. Therefore, for example, the pulse width of the first power switch 132 is the duration of time from time t1 to time t6.

At time t7 the state 402 of the second power switch 134 changes to a high state and returns to a low state at time t8. After time t7 and prior to time t8, the states 406, 408, 410 of the current switches 126, 128, 130 change from a low state to a high state, before returning to a low state.

At time t9 the state 404 of the third power switch 136 changes to a high state and returns to a low state at time t10. After time t9 and prior to time t10, the states 406, 408, 410 of the current switches 126, 128, 130 change from a low state to a high state, before returning to a low state.

As can be seen from FIG. 4, one of the power switches 132, 134, 136 is on prior to the current switches 126, 128, 130 switching on. When one of the current switches 126, 128, 130 is on it is used to generate a required average current to switch on and illuminate a corresponding LED.

The combinations of power switches 132, 134, 136 and current switches 126, 128, 130 that result in a specific LED being switched on, which may be referred to as the LED being in an on state, are discussed below. If an LED is not switched on, it is switched off, which may be referred to as the LED being in an off state.

When the first power switch 132 and the first current switch 126 are on, the first LED 108 is switched on. When the first power switch 132 and the second current switch 128 are on, the fourth LED 114 is switched on. When the first power switch 132 and the third current switch 130 are on, the seventh LED 120 is switched on.

When the second power switch 134 and the first current switch 126 are on, the second LED 110 is switched on. When the second power switch 134 and the second current switch 128 are on, the fifth LED 116 is switched on. When the second power switch 134 and the third current switch 130 are on, the eighth LED 122 is switched on.

When the third power switch 136 and the first current switch 126 are on, the third LED 112 is switched on. When the third power switch 136 and the second current switch 128 are on, the sixth LED 118 is switched on. When the third power switch 132 and the third current switch 130 are on, the ninth LED 122 is switched on.

A multiplex period is a duration of time from a power switch changing to a high state, to the next power switch changing to a high state. Therefore, for example, a first multiplex period is the duration of time from time t1 to time t7, and a second multiplex period is the duration of time from time t7 to t9.

At time t1, corresponding to the beginning of the first multiplex period, the first power switch 132 is closed as shown by the state 400 being high. From time t1 to t2, the closed first power switch 132 results in charging of the first parasitic capacitor 200 thereby increasing the first anode voltage S1.

At time t2, the current switches 126, 128, 130 are closed, as shown by the states 406, 408, 410 being high. This causes a current to flow through the first LED 108, the fourth LED 114 and the seventh LED 120, which results in charging of the fourth, fifth and sixth parasitic capacitors 206, 208, 210 which increases the first cathode voltage D1, the second cathode voltage D2 and the third cathode voltage D3, respectively.

At time t3 the first current switch 126 is opened as shown by the state 406 changing to low. Current will continue to flow through the first LED 108 and charge the fourth parasitic capacitor 206 until the first cathode voltage D1 reaches a value in which approximately a threshold voltage of the first LED 108 is across the first LED 108; at this point no current will flow through the first LED 108.

At time t4 the second current switch 128 is opened as shown by the state 408 changing to low. Current will continue to flow through the fourth LED 114 and charge the fifth parasitic capacitor 208 until the second cathode voltage D2 reaches a value in which approximately a threshold voltage of the fourth LED 114 is across the fourth LED 114; at this point no current will flow through the fourth LED 114.

At time t5 the third current switch 130 is opened as shown by the state 410 changing to low. Current will continue to flow through the seventh LED 120 and charge the sixth parasitic capacitor 210 until the third cathode voltage D3 reaches a value in which approximately a threshold voltage of the seventh LED 120 is across the seventh LED 120; at this point no current will flow through the seventh LED 120.

At time t6 the first power switch 132 is open as shown by the state 400 changing to low. The first parasitic capacitor 200 will hold the first anode voltage S1 at its present value.

The second multiplex period begins at time t7 with the closing of the second power switch 134 and the switching operation proceeds similarly to as described for the first multiplex period. Based on the description of the first multiplex period, it will be clear to the skilled person how to interpret operation of subsequent multiplex periods as presented in FIG. 4.

Within the second multiplex period, there are periods of time over which the first, second and third current switches 126, 128, 130 are closed, as shown in the states 406, 408, 410. During the time period over which the first current switch 126 is closed, current flows through the second LED 110. During the time period over which the second current switch 128 is closed, current flows through the fifth LED 116. During the time period over which the third current switch 130 is closed, current flows through the eighth LED 122.

After the first current switch 126 is opened, current continues to flow through the second LED 110 and charges the fourth parasitic capacitor 206 until the first cathode voltage D1 reaches a value in which approximately a threshold voltage of the second LED 110 is across the second LED 110; at this point no current will flow through the second LED 110.

If the threshold voltage of the second LED 110 is greater than the threshold voltage of the first LED 108 then the first cathode voltage D1 after no more current flows through the second LED 110 during the second multiplex period, will be lower than the first cathode voltage D1 after no more current flows through the first LED 108 during the first multiplex period. This will result in discharging of the first parasitic capacitor 200 such that a parasitic current will flow through the first LED 108, which may result in it being illuminated dimly, as is characteristic of a ghost image.

After the second current switch 128 is opened, current continues to flow through the fifth LED 116 and charges the fifth parasitic capacitor 208 until the second cathode voltage D2 reaches a value in which approximately a threshold voltage of the fifth LED 116 is across the fifth LED 116; at this point no current will flow through the fifth LED 116.

If the threshold voltage of the fifth LED 116 is greater than the threshold voltage of the fourth LED 114 then the second cathode voltage D2 after no more current flows through the fifth LED 116 during the second multiplex period, will be lower than the second cathode voltage D2 after no more current flows through the fourth LED 114 during the first multiplex period. This will result in discharging of the first parasitic capacitor 200 such that a parasitic current will flow through the fourth LED 114, which may result in it being illuminated dimly, as is characteristic of a ghost image.

After the third current switch 130 is opened, current continues to flow through the eighth LED 122 and charges the sixth parasitic capacitor 210 until the third cathode voltage D3 reaches a value in which approximately a threshold voltage of the eighth LED 122 is across the eighth LED 122; at this point no current will flow through the eighth LED 122.

If the threshold voltage of the eighth LED 122 is greater than the threshold voltage of the seventh LED 120 then the third cathode voltage D3 after no more current flows through the eighth LED 122 during the second multiplex period, will be lower than the third cathode voltage D3 after no more current flows through the seventh LED 120 during the first multiplex period. This will result in discharging of the first parasitic capacitor 200 such that a parasitic current will flow through the seventh LED 120, which may result in it being illuminated dimly, as is characteristic of a ghost image.

Ghost images of the type arising from the procedure described above, where the first, second or third parasitic capacitors 200, 202, 204 are discharged may be referred to as upper ghost images.

A different type of ghost image, which may be referred to as lower ghost images, can arise when the parasitic capacitors 200, 202, 204, 206, 208, 210 are substantially discharged such that the first, second and third anode voltages S1, S2, S3 and the first, second and third cathode voltages D1, D2, D3 are small. This may arise, for example, if the multiplexed LED array 100 is implemented in an LED display and a black screen has been displayed for a period of time.

At time t1, the first power switch 132 is closed and the current switches 126, 128, 130 remain open. A parasitic current can then flow through the first, fourth and seventh LEDs 108, 114, 120, which will charge the fourth, fifth and sixth parasitic capacitors 206, 208, 210 respectively. The first, fourth and seventh LEDs 108, 114, 120 may illuminate dimly, corresponding to ghost images of the type that may be referred to as lower ghost images. Lower ghost images arise from the charging of the fourth, fifth or sixth parasitic capacitors 206, 208, 210.

The generation of lower ghost images by operation of the second and third power switches 134, 136 will similarly be appreciated by the skilled person.

It will be appreciated that lower ghost images may occur in a circuit comprising one or more LEDs. Additionally, upper ghost images may be present in a circuit comprising one or more LEDs. With regards to upper ghost images, this disclosure has described, for example, illumination of a first LED followed by a second LED leading to a ghost image in the first LED. It will be appreciated that another circuit element, for example a standard diode, may fulfill the role of the second LED, such that there may be a difference in threshold voltage that leads to parasitic capacitance discharge that leads to a ghost image in the first LED. Therefore, an upper ghost image may arise in a circuit comprising a single LED.

Existing systems implement additional, dedicated circuitry to provide a resistive discharge path to discharge the parasitic capacitances as a means of preventing the occurrence of ghost images. The resistive discharge is applied between a power switch opening and the next power switch closing. This ensures that during the next multiplex period, the parasitic capacitance is discharged sufficiently to ensure that ghost imaging does not occur.

The present disclosure provides a method in which the timing of the switching operation of the power switches 132, 134, 136 and the current switches 126, 128, 130 is used to remove ghost images. This eliminates the requirement for additional, dedicated components and/or circuitry, and can also enable a reduction in dead time. The dead time is a time period between a power switch opening, and the next power switch closing, which must be of a sufficient duration in the prior art to enable resistive discharge of the parasitic capacitances.

Figure 14:
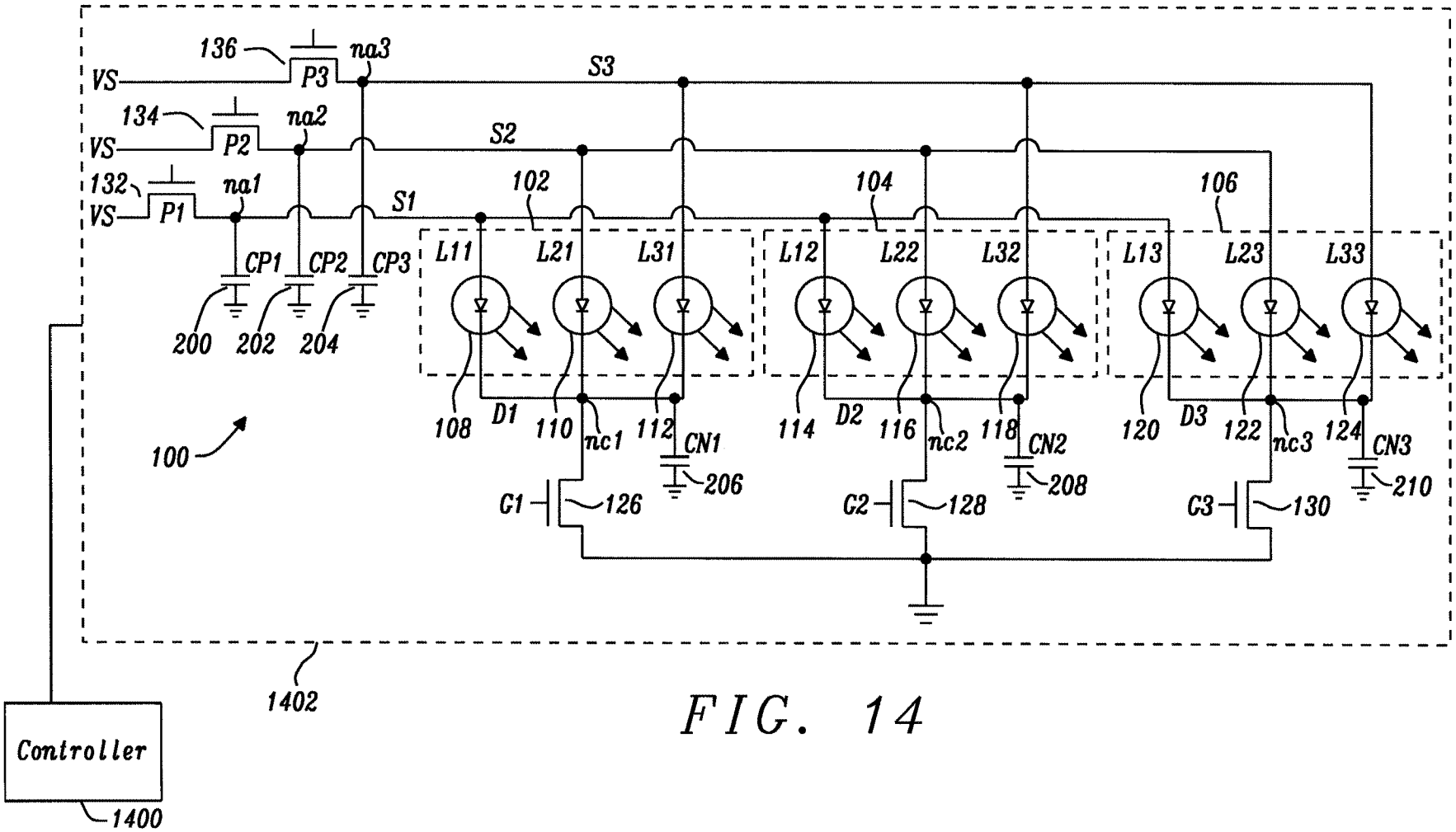
FIG. 14 is a schematic diagram of a controller coupled to a multiplexed LED array.

FIG. 14 shows a schematic of a controller 1400 coupled to a multiplexed LED array 1402. The multiplexed LED array 1402 may correspond to the multiplexed LED array 100 shown in FIG. 1 and FIG. 2. The controller 1400 is arranged to control the switching operation of the current switches 126, 128, 130 and the power switches 132, 134, 136 of the multiplexed LED array 1402. The controller 1400 comprises memory to store instructions, where the instructions define the timing sequence of the switching operation of the current switches 126, 128, 130 and the power switches 132, 134, 136. The controller may provide a PWM signal to control the switching of the current switches 126, 128, 130 and the power switches 132, 134, 136. The controller may comprise a processor and may receive feedback from the multiplexed LED array 1402.

Figure 5:
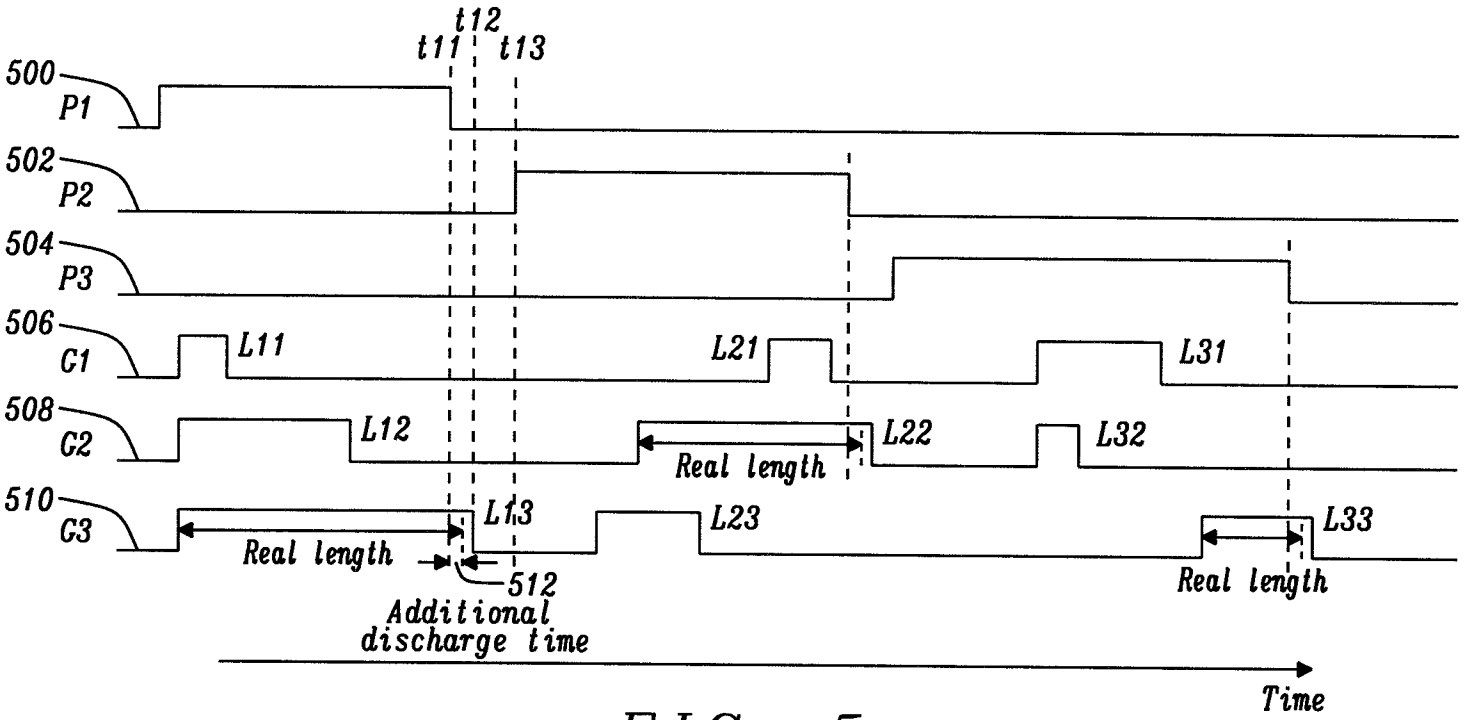
FIG. 5 is a timing sequence of the switching operation of the multiplexed LED array of FIG. 1 and FIG. 2 in accordance with a first embodiment of the present disclosure.

FIG. 5 shows a timing sequence of the switching operation of the multiplexed LED array 100 of FIG. 1 and FIG. 2, to eliminate upper ghost images, in accordance with a first embodiment of the present disclosure.

The timing sequence shows the following: a state 500 of the first power switch 132; a state 502 of the second power switch 134; a state 504 of the third power switch 136; a state 506 of the first current switch 126; a state 508 of the second current switch 128; and a state 510 of the third current switch 130.

The timing sequence is as described for FIG. 4, however in FIG. 5, within a multiplex period, one of the current switches remains closed when a power switch is opened. In the first multiplex period, the first power switch 132 changes from high to low, as shown by the state 500 at time t11. The third current switch 130 remains closed until time t12, where time t12 is after time t11.

This is achieved by reducing the pulse width of the first power switch 132, such that the first power switch 132 is opened earlier than shown in FIG. 4. However, it will be appreciated that lengthening the duration of the time over which the third current switch 130 remains closed would also yield a similar result.

As the third current switch 130 remains closed when the first power switch 132 is open, the first parasitic capacitor 200 is discharged, such that the first anode voltage S1 is reduced. The first parasitic capacitor 200 may be partially or fully discharged by time t12. Additional discharge time 512 shown in FIG. 5 shows the time taken to discharge the first parasitic capacitor 200, such that in this embodiment it is fully discharged prior to the third current switch 130 being opened.

It will be appreciated that it is also possible to discharge the first parasitic capacitor 200 by opening the third current switch 130 prior to or at time t11, closing the third current switch 130 after time t11, and re-opening the third current switch 130 prior to time t13, where time t13 is the end of the first multiplex period.

Based on the description of the first multiplex period herein, it is clear to the skilled person how to interpret operation of subsequent multiplex periods and discharging of the parasitic capacitors 202, 204 as presented in FIG. 5.

As the parasitic capacitors 200, 204, 206 are discharged using the timing sequence of FIG. 5, upper ghost images are substantially or entirely removed. It should be noted that in removing the upper ghost image, the parasitic capacitors 200, 202, 204, 206, 208, 210 may be substantially discharged such that lower ghost images may arise, as described previously.

Figure 6:
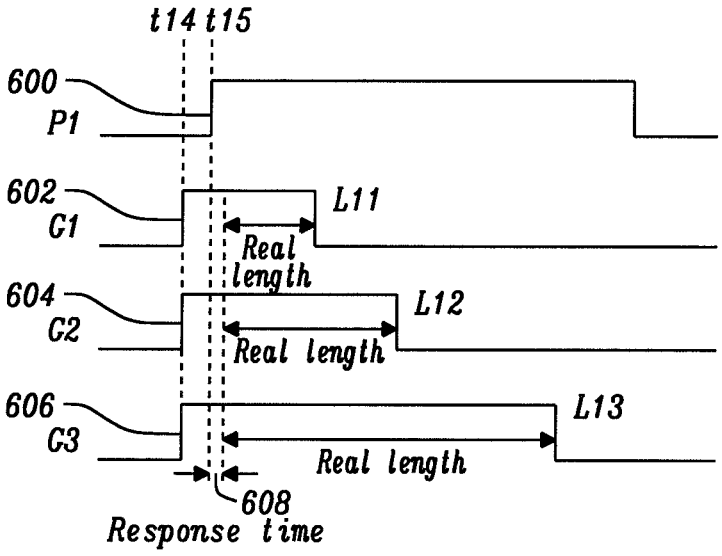
FIG. 6 is a timing sequence of the switching operation of the multiplexed LED array of FIG. 1 and FIG. 2 in accordance with a second embodiment of the present disclosure.

FIG. 6 shows a timing sequence of the switching operation of the multiplexed LED array 100 of FIG. 1 and FIG. 2, to eliminate lower ghost images, in accordance with a second embodiment of this disclosure. FIG. 6 shows the first multiplex period for switching of the first power switch 132.

It will be clear to the skilled person how subsequent multiplex periods should be interpreted.

The timing sequence shows the following: a state 600 of the first power switch 132; a state 602 of the first current switch 126; a state 604 of the second current switch 128; and a state 606 of the third current switch 130.

The timing sequence is as described for FIG. 4, however in FIG. 6, the current switches 126, 128, 130 are closed at time t14, as shown by the states 602, 604, 606, The current switches 126, 128, 130 are closed prior to the first power switch 132 being closed at time t15, as shown by state 600.

In FIG. 4, as the first power switch 132 is closed whilst the current switches 126, 128, 130 remain open, a parasitic current can flow through LEDs, which will charge the fourth, fifth and sixth parasitic capacitors 206, 208, 210. This sequence can lead to the occurrence of lower ghost images as discussed previously. In FIG. 6, the current switches 126, 128, 130 are closed prior to the first power switch 132 closing at time t15, such that the fourth, fifth and sixth parasitic capacitors 206, 208, 210 are continually discharged. Consequently, charge cannot accumulate and there is no opportunity for charging of the fourth, fifth and sixth parasitic capacitors 206, 208, 210 prior to the time t15. Therefore, lower ghost images are not present in this embodiment.

It will be appreciated that it will also be possible to prevent charging of the fourth, fifth and sixth parasitic capacitors 206, 208, 210 by closing the current switches 126, 128, 130 at the same time as the first power switch 132 is closed, at time t15.

A response time 608 is a duration of time after which both the first power switch 132 and a current switch are closed before current begins to flow through the corresponding LED. In FIG. 6 the current switches 126, 128, 130 are closed at the same time such that the response time 608 before current begins to flow through each of the first, fourth and seventh LEDs 108, 114, 120 is the same.

Figure 7:
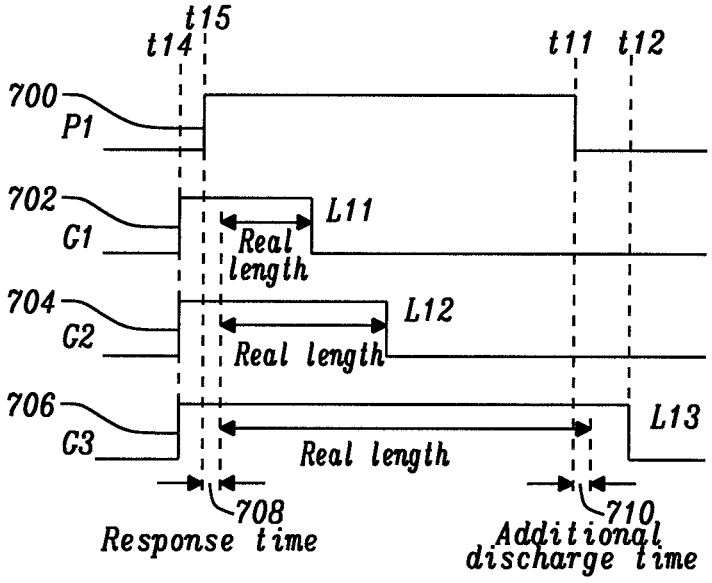
FIG. 7 is a timing sequence of the switching operation of the multiplexed LED array of FIG. 1 and FIG. 2 in accordance with a third embodiment of the present disclosure.

FIG. 7 shows a timing sequence of the switching operation of the multiplexed LED array 100 of FIG. 1 and FIG. 2, to eliminate upper ghost images and lower ghost images, in accordance with a third embodiment of the present disclosure. FIG. 7 shows the first multiplex period for switching of the first power switch 132. It will be clear to the skilled person how subsequent multiplex periods should be interpreted.

The timing sequence shows the following: a state 700 of the first power switch 132; a state 702 of the first current switch 126; a state 704 of the second current switch 128; a state 706 of the third current switch 130; a response time 708; and additional discharge time 710. FIG. 7 combines the upper ghost image removal method of FIG. 5 and the lower ghost image removal method of FIG. 6 to provide a method for removal of both types of ghost images.

The description provided for FIG. 5 and FIG. 6 also describes the operation of the upper and lower ghost image removal methods of FIG. 7, respectively. Times t11, t12, t14, and t15, as described in FIG. 5 and FIG. 6 are shown on FIG. 7.

The instructions that are stored in the memory of the controller 1400 may correspond to the timing sequences of the switching operation of the multiplexed LED array 100 corresponding to the first, second or third embodiments of the present disclosure. Therefore, the controller 1400 may be arranged to implement the embodiments of this disclosure.

To ensure suitable timing operation of the power and current switches 126, 128, 130, 132, 134, and 138 to remove upper ghost imaging it is necessary to calculate the discharge time that is required. To ensure suitable timing operation of the power and current switches 126, 128, 130, 132, 134, and 138 to remove upper ghost imaging it is necessary to calculate the response time that is required.

Figure 8:
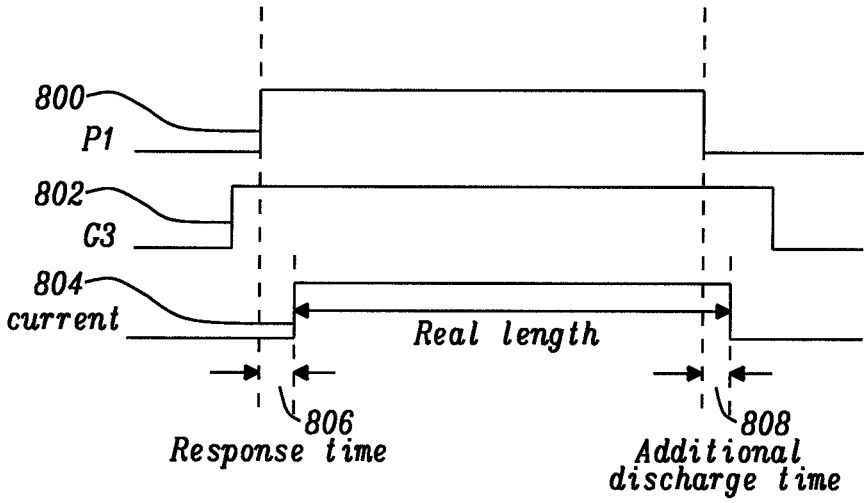
FIG. 8 is a timing sequence of the switching operation of the multiplexed LED array of FIG. 1 and FIG. 2 in accordance with the third embodiment of the present disclosure.

FIG. 8 shows a timing sequence of the switching operation of the first power switch 132 and the third current switch 130 of the multiplexed LED array 100 of FIG. 1 and FIG. 2. It will be appreciated that the following description may be applied to any combination of a power switch with a current switch.

The timing sequence shows the following: a state 800 of the first power switch 132; a state 802 of the third current switch 130; a current 804 that flows through the seventh LED 120; a response time 806; and additional discharge time 808. The response time 806 is the time after which the first power switch 132 and the third current switch 130 are both closed before current 804 begins to flow through the seventh LED 120. The discharge time 808 is the time taken to discharge the first parasitic capacitor 200. A high signal of current 804 denotes current flow and a low signal of current 804 denotes no current flow.

To measure the response time 806 it is possible to measure the time taken from the first power switch 132 turning on to the current 804 reaching a constant value. To measure the discharge time 808 it is possible to measure the time taken from the first power switch 132 turning off to the current 804 being reduced to approximately zero. It is possible to measure both the response time 806 and the discharge time 808 in different channels, where channels refer to LED strings. For example, the first LED string 102 may be used to measure the response time 806 and the second LED string 104 may be used to measure the discharge time 808.

Figure 9:
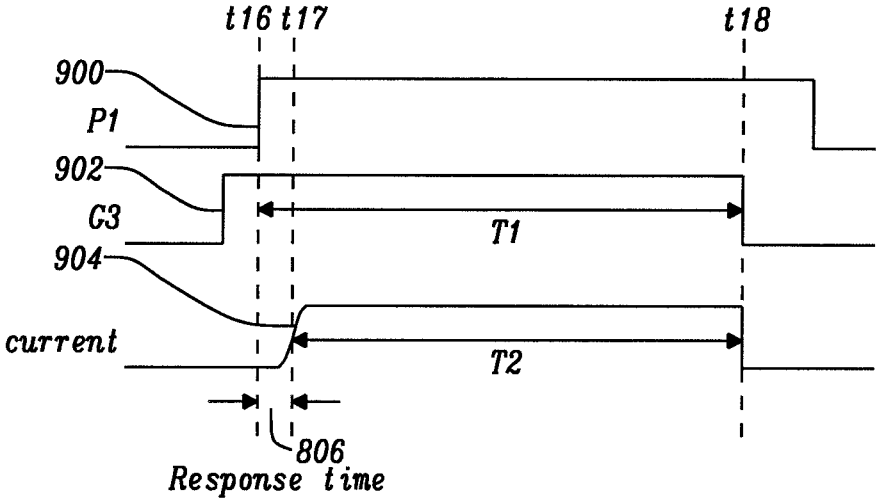
FIG. 9 is a timing sequence of the switching operation of the multiplexed LED array of FIG. 1 and FIG. 2 in accordance with the second embodiment of the present disclosure.

It is also possible to calculate the response time 806 and the discharge time 808. FIG. 9 shows a timing sequence that illustrates how the response time 806 may be calculated. The timing sequence shows the following: a state 900 of the first power switch 132; a state 902 of the third current switch 130; a current 904 that flows through the seventh LED 120; and the response time 806. To calculate the response time 806, the third current switch 130 must be closed prior to the first power switch 132 being closed.

At time t16 both the first power switch 132 and the third current switch 130 are closed and the current 904 begins to rise. At time t17 the current 904 is in a high state, which shows that it has reached an approximately constant value. At time t18 the third current switch is opened. The response time 806 is a duration of time from time t16 to time t17. A time period T1 is a duration of time from time t16 to t18. A time period T2 is a duration of time from time t17 to t18.

Figure 10:
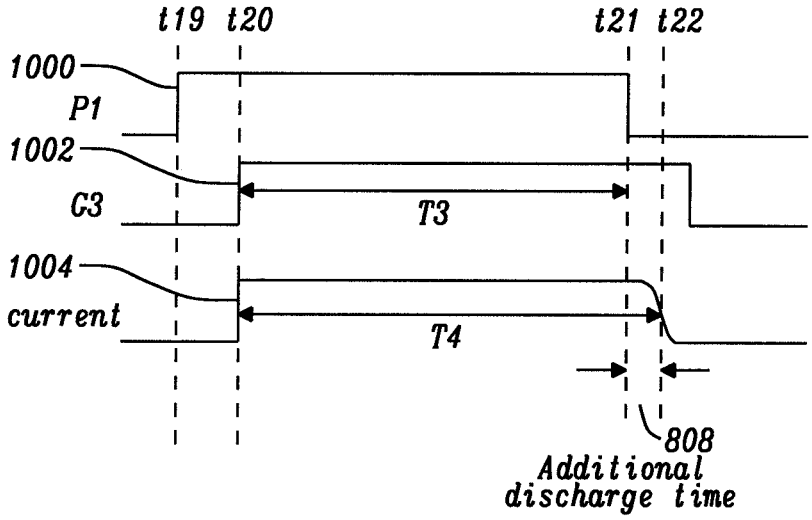
FIG. 10 is a timing sequence of the switching operation of the multiplexed LED array of FIG. 1 and FIG. 2 in accordance with the first embodiment of the present disclosure.

FIG. 10 shows a timing sequence that illustrates how the additional discharge time 808 may be calculated. The timing sequence shows the following: a state 1000 of the first power switch 132; a state 1002 of the third current switch 130; a current 1004 that flows through the seventh LED 120; and the discharge 808. To calculate the discharge time 808, the first power switch 132 must be closed prior to the third current switch 130 being closed.

At time t16 both the first power switch 132 and the third current switch 130 are closed and the current 904 begins to rise. At time t17 the current 904 is in a high state, which shows that it has reached an approximately constant value. At time t18 the third current switch is opened. The response time 806 is a duration of time from time t16 to time t17. A time period T1 is a duration of time from time t16 to t18. A time period T2 is a duration of time from time t17 to t18.

At time t19 the first power switch 132 is closed. At time t20 the third current switch 130 is closed such that both the first power switch 132 and the third current switch 130 are closed. At time t21 the first power switch 132 is opened and the current 1004 begins to fall from an approximately constant value. At time t22 the current 1004 has fallen to approximately zero. The discharge time 808 is a duration of time from time t21 to time t22. A time period T3 is a duration of time from time t20 to time t21. A time period T4 is a duration of time from time t20 to time t22.

When implemented in a chip, the switching operation of the first power switch 132 and the third current switch 130 will be controlled by logic operations within the chip. The chip user will be able to determine the time period T1 and the time period T3 based on the operation of the chip. The current 904 is measurable such that it is possible to measure the time period T2 and the time period T4. The response time 806 is equal to T1−T2. The discharge time 808 is equal to T4−T3.

It is also possible to calculate the time period T2 using the following equation:

$$T2=(\int current1\times dt1)/average_current1$$

where current1 is the current 904, dt1 is a first time step and average_current1 is an average current of the current 904 over a time interval defined in the integral.

It is also possible to calculate the time period T4 using the following equation:

$$T4=(\int current2\times dt2)/average_current2$$

where current2 is the current 1004, dt2 is a second time step and average_current2 is an average current of the current 1004 over a time interval defined in the integral.

Figure 11:
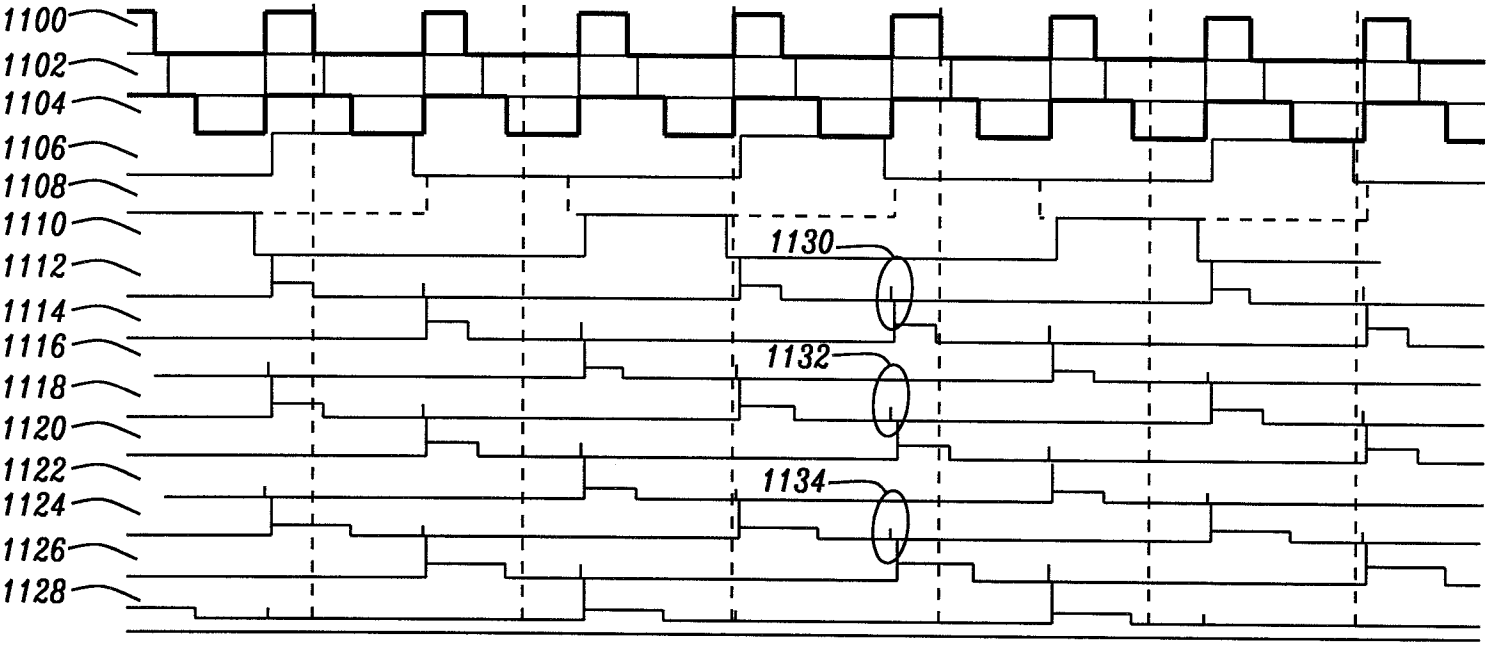
FIG. 11 shows simulation results of a timing sequence of the switching operation of the multiplexed LED array of FIG. 1 and FIG. 2 that results in the occurrence of upper ghost images.

FIG. 11 shows simulation results of a timing sequence of the switching operation of the multiplexed array 100 of FIG. 1 and FIG. 2, demonstrating the occurrence of upper ghost images.

The timing sequence shows the following: a state 1100 of the first current switch 126; a state 1102 of the second current switch 128; a state 1104 of the third current switch 130; a state 1106 of the first power switch 132; a state 1108 of the second power switch 134; a state 1110 of the third power switch 136; a current 1112 that flows through the first LED 108; a current 1114 that flows through the second LED 110; a current 1116 that flows through the third LED 112; a current 1118 that flows through the fourth LED 114; a current 1120 that flows through the fifth LED 116; a current 1122 that flows through the sixth LED 118; a current 1124 that flows through the seventh LED 120; a current 1126 that flows through the eighth LED 122; and a current 1128 that flows through the ninth LED 124.

Current spikes 1130, 1132, 1134 show current flowing through LEDs that should be switched off, based on the state of the associated power and current switches 126, 128, 130, 132, 134, 136. The current spikes 1130, 1132, 1134 may be referred to as parasitic currents and result in upper ghost images.

Figure 12:
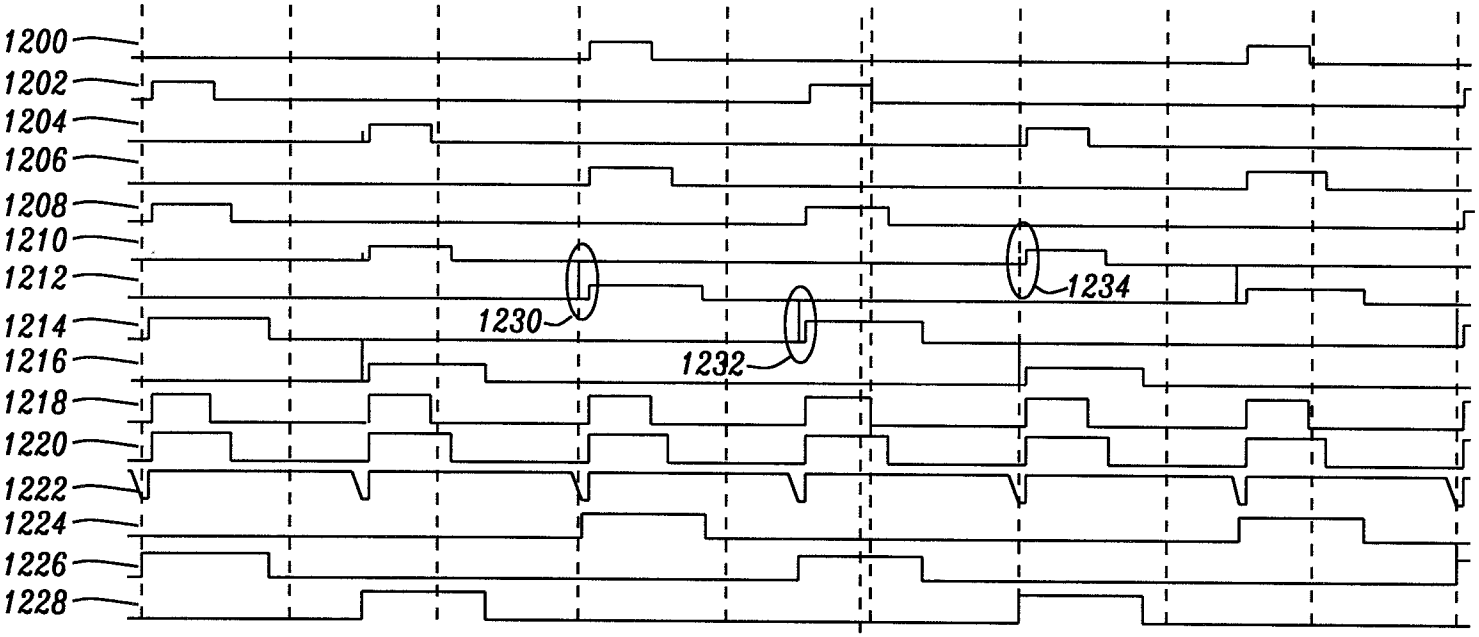
FIG. 12 shows simulation results of a timing sequence of the switching operation of the multiplexed LED array of FIG. 1 and FIG. 2 that results in the occurrence of lower ghost images.

FIG. 12 shows simulation results of a timing sequence of the switching operation of the multiplexed array 100 of FIG. 1 and FIG. 2, demonstrating the occurrence of lower ghost images.

The timing sequence shows the following: a current 1200 that flows through the first LED 108; a current 1202 that flows through the second LED 110; a current 1204 that flows through the third LED 112; a current 1206 that flows through the fourth LED 114; a current 1208 that flows through the fifth LED 116; a current 1210 that flows through the sixth LED 118; a current 1212 that flows through the seventh LED 120; a current 1214 that flows through the eighth LED 122; a current 1216 that flows through the ninth LED 124; a state 1218 of the first current switch 126; a state 1220 of the second current switch 128; a state 1222 of the third current switch 130; a state 1224 of the first power switch 132; and a state 1226 of the second power switch 134; a state 1228 of the third power switch 136.

Current spikes 1230, 1232, 1234 show current flowing through LEDs that should be switched off, based on the state of the associated power and current switches 126, 128, 130, 132, 134, 136. The current spikes 1230, 1232, 1234 may be referred to as parasitic currents that result in lower ghost images.

Figure 13:
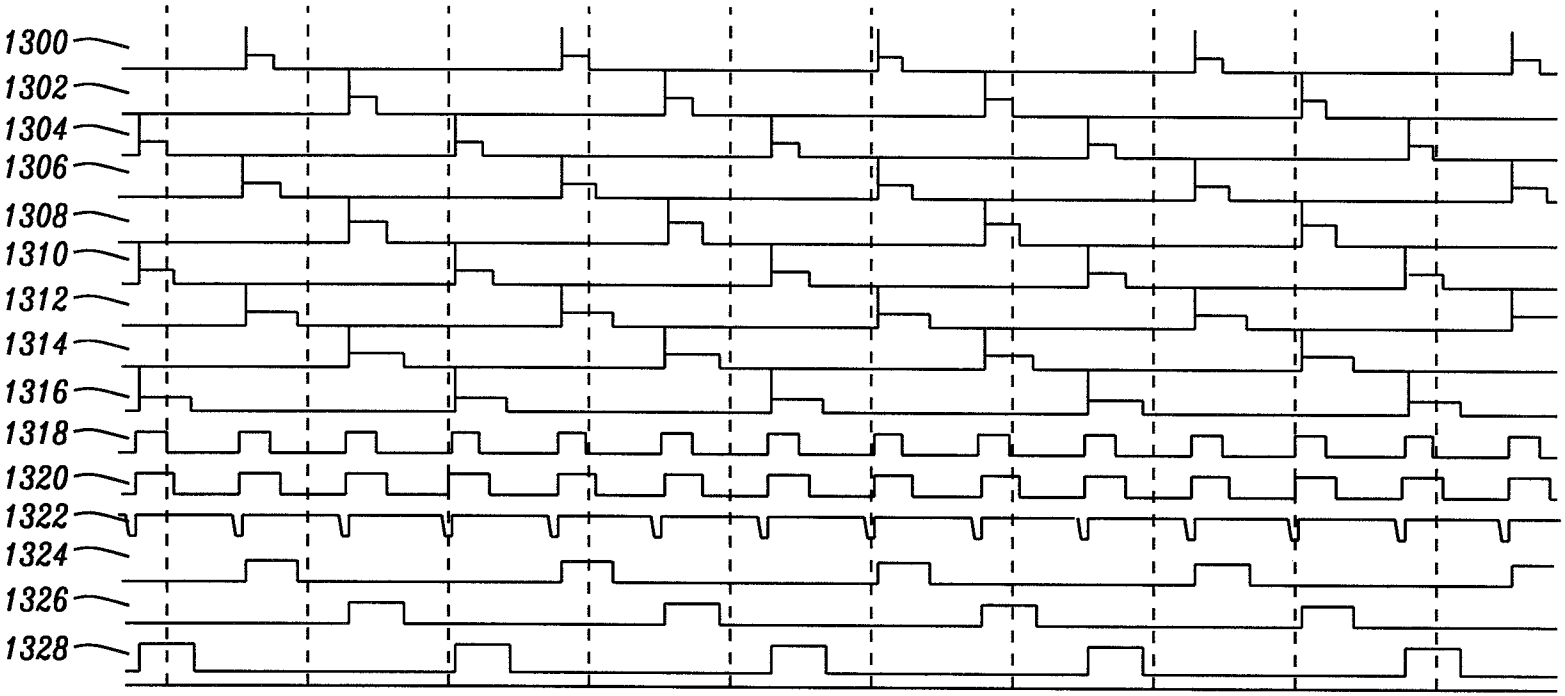
FIG. 13 shows simulation results of a timing sequence of the switching operation of the multiplexed LED array of FIG. 1 and FIG. 2 in accordance with the third embodiment of the present disclosure, that results in the removal of ghost images.

FIG. 13 shows simulation results of a timing sequence of the switching operation of the multiplexed array 100 of FIG. 1 and FIG. 2, implementing the third embodiment of the present disclosure such that no ghost images are present.

The timing sequence shows the following: a current 1300 that flows through the first LED 108; a current 1302 that flows through the second LED 110; a current 1304 that flows through the third LED 112; a current 1306 that flows through the fourth LED 114; a current 1308 that flows through the fifth LED 116; a current 1310 that flows through the sixth LED 118; a current 1312 that flows through the seventh LED 120; a current 1314 that flows through the eighth LED 122; a current 1316 that flows through the ninth LED 124; a state 1318 of the first current switch 126; a state 1320 of the second current switch 128; a state 1322 of the third current switch 130; a state 1324 of the first power switch 132; and a state 1326 of the second power switch 134; a state 1328 of the third power switch 136.

Figure 15:
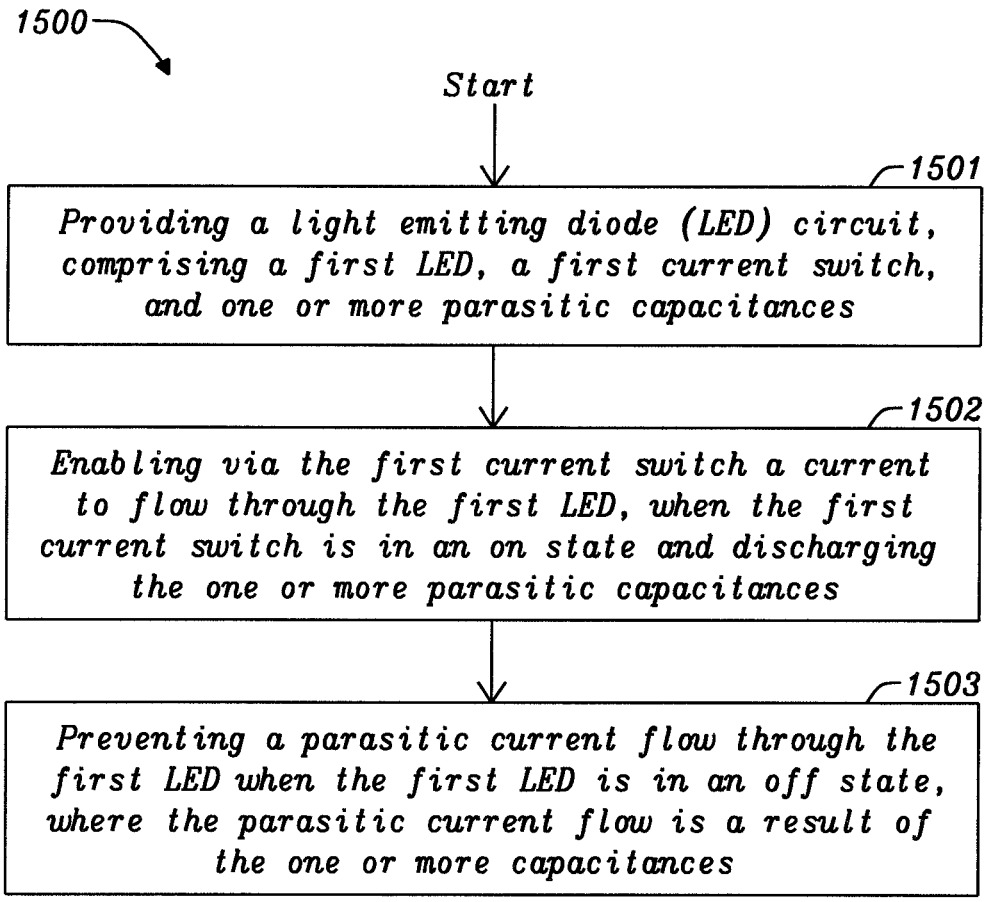
FIG. 15 is a flowchart for a method of operating a light emitting diode (LED) circuit, in the present disclosure.

FIG. 15 is flowchart 1500, for a method of operating a light emitting diode (LED) circuit, in the present disclosure. The steps include 1501, providing a light emitting diode (LED) circuit, comprising a first LED, a first current switch, and one or more parasitic capacitances. The steps also include 1502, enabling via the first current switch a current to flow through the first LED, when the first current switch is in an on state and discharging the one or more parasitic capacitances. The steps also include 1503, preventing a parasitic current flow through the first LED when the first LED is in an off state, where the parasitic current flow is a result of the one or more parasitic capacitances.

It will be appreciated that the embodiments presented have been shown for 9 LEDs however, this disclosure may be applied to resolve ghost imaging issues arising in a LED circuit implementing any number of LEDs, including an LED circuit comprising a single LED.

Various improvements and modifications may be made to the above without departing from the scope of the disclosure.

What is claimed is:

1. A light emitting diode (LED) circuit for preventing parasitic current flow through a first LED when the first LED is in an off state, wherein the parasitic current flow is a result of one or more parasitic capacitances, the LED circuit comprising:

the first LED;

a first power switch, wherein the first LED is coupled to a supply voltage when the first power switch is in an on state, and the first LED is decoupled from the supply voltage when the first power switch is in an off state; and:

a first current switch coupled to the first LED and arranged to enable a current flow through the first LED when the first current switch is in an on state, wherein:

the first current switch is arranged to discharge the one or more parasitic capacitances when:

a) the first current switch and the first power switch are both in the on state by:

i) being in the on state prior to the first power switch changing to the on state and remaining in the on state at least until the first power switch changes to the on state; or:

ii) changing to the on state at approximately the same time as the first power switch changes to the on state; or:

b) the first current switch is in the on state and the first power switch is in the off state by being in the on state after the first power switch has changed to the off state.

2. The LED circuit of claim 1, wherein the first current switch provides a current regulation function to provide the current flow through the first LED when the first current switch is in an on state.

3. The LED circuit of claim 1, wherein the first LED is in an on state when the first LED is coupled to a supply voltage and the first current switch is in the on state, otherwise the first LED is in the off state.

4. The LED circuit of claim 1, wherein the first current switch remains in the on state while the first power switch changes from the on state to the off state.

5. The LED circuit of claim 1, wherein the parasitic capacitances comprise a first parasitic capacitance and a second parasitic capacitance.

6. The LED circuit of claim 5, comprising:

a second LED; and a second current switch coupled to the second LED and arranged to enable a current flow through the second LED when the second current switch is in an on state, wherein:

the second current switch is arranged to discharge the one or more of the first parasitic capacitance and other parasitic capacitances when the second current switch is in the on state.

7. The LED circuit of claim 6, wherein the other parasitic capacitances comprise a third parasitic capacitance.

8. The LED circuit of claim 7, wherein:

the first current switch provides a first current regulation function to provide the current flow through the first LED when the first current switch is in an on state and the first current switch is arranged to discharge one or more of the first and second parasitic capacitances; and the second current switch provides a second current regulation function to provide the current flow through the second LED when the second current switch is in an on state and the second current switch is arranged to discharge one or more of the first and third parasitic capacitances.

9. The LED circuit of claim 7, wherein:

the first LED is in an on state when the first LED is coupled to a supply voltage and the first current switch is in the on state, otherwise the first LED is in the off state; and the second LED is in an on state when the second LED is coupled to the supply voltage and the first current switch is in the on state, otherwise the second LED is in the off state.

10. The LED circuit of claim 9 comprising:

the first power switch, wherein:

the first LED is coupled to the supply voltage when the first power switch is in an on state, and the first LED is decoupled from the supply voltage when the first power switch is in an off state; and the second LED is coupled to the supply voltage when the first power switch is in an on state, and the second LED is decoupled from the supply voltage when the first power switch is in an off state.

11. The LED circuit of claim 10, wherein one or both of the first current switch and the second current switch are in the on state prior to the first power switch changing to the on state.

12. The LED circuit of claim 1, comprising one or more LED strings, wherein each LED string comprises one or more LEDs.

13. A method of operating a light emitting diode (LED) circuit of the type comprising a first LED, a first current switch, one or more parasitic capacitances and a first power switch, wherein the first LED is coupled to a supply voltage when the first power switch is in an on state, and the first LED is decoupled from the supply voltage when the first power switch is in an off state, the method comprising:

enabling, via the first current switch, a current to flow through the first LED when the first current switch is in an on state;

discharging, via the first current switch, the one or more parasitic capacitances when:

a) the first current switch and the first power switch are both in the on state by:

i) being in the on state prior to the first power switch changing to the on state and remaining in the on state at least until the first power switch changes to the on state; or:

ii) changing to the on state at approximately the same time as the first power switch changes to the on state; or:

b) the first current switch is in the on state and the first power switch is in the off state by being in the on state after the first power switch has changed to the off state; and:

preventing parasitic current flow through the first LED when the first LED is in an off state, wherein the parasitic current flow is a result of the one or more parasitic capacitances.

14. A controller for preventing parasitic current flow through a first LED when the first LED is in an off state, wherein the parasitic current flow is a result of one or more parasitic capacitances, wherein:

the controller is arranged to control the switching of a first current switch; wherein:

the first LED is coupled to a supply voltage when a first power switch is in an on state, and the first LED is decoupled from the supply voltage when the first power switch is in an off state;

the first current switch is coupled to the first LED and arranged to enable a current flow through the first LED when the first current switch is in an on state; and the first current switch is arranged to discharge the one or more parasitic capacitances when:

a) the first current switch and the first power switch are both in the on state by:

i) being in the on state prior to the first power switch changing to the on state and remaining in the on state at least until the first power switch changes to the on state; or:

ii) changing to the on state at approximately the same time as the first power switch changes to the on state; or:

b) the first current switch is in the on state and the first power switch is in the off state by being in the on state after the first power switch has changed to the off state.

* * * * *